US006318588B1

(12) United States Patent
Lichtenwalner

(10) Patent No.: US 6,318,588 B1
(45) Date of Patent: Nov. 20, 2001

(54) GARDEN DEBRIS CONTAINER

(76) Inventor: Lynn Lichtenwalner, 6572 Lower Macungie Rd., Macungie, PA (US) 18062

( * ) Notice: Subject to any disclaimer, the term of this patent is extended or adjusted under 35 U.S.C. 154(b) by 0 days.

(21) Appl. No.: 09/523,119

(22) Filed: Mar. 10, 2000

(51) Int. Cl.[7] ..... B65F 1/04

(52) U.S. Cl. ..... 220/908.3; 220/908; 280/47.26

(58) Field of Search ..... 280/47.26, 47.17, 280/47.31, 79.2; 220/908, 908.3

(56) References Cited

U.S. PATENT DOCUMENTS

| | | | | |
|---|---|---|---|---|
| D. 357,779 | | 4/1995 | Breen . | |
| 3,170,183 | | 2/1965 | Leatherman . | |
| 3,875,981 | | 4/1975 | Brenner et al. . | |
| 4,312,531 | * | 1/1982 | Cross | 294/55 |
| 4,442,567 | * | 4/1984 | Pravettone | 15/257.4 |
| 4,503,661 | * | 3/1985 | Potter | 56/16.6 |
| 4,600,113 | | 7/1986 | De Mars . | |
| 4,697,835 | | 10/1987 | Scott . | |
| 4,992,018 | * | 2/1991 | Prout et al. | 220/908 |
| 5,088,531 | | 2/1992 | Wade . | |
| 5,235,795 | * | 8/1993 | DeBusk | 53/467 |
| 5,538,158 | * | 7/1996 | Prout et al. | 220/771 |
| 5,636,416 | * | 6/1997 | Anderson | 24/510 |
| 5,738,395 | * | 4/1998 | Probst | 292/230 |
| 5,785,369 | * | 7/1998 | Ridley, Sr. et al. | 294/1.1 |

* cited by examiner

*Primary Examiner*—J. J. Swann
*Assistant Examiner*—James S. McClellan

(57) ABSTRACT

A garden debris container for easy collection of garden debris. The garden debris container includes a housing. The housing has a bottom wall. A peripheral wall is coupled to and extends away from the bottom wall. The peripheral wall has free edge. A flange is coupled to the free edge of the peripheral wall. The flange extends in a direction generally away from the bottom wall.

5 Claims, 2 Drawing Sheets

12
22
10
38
24
30
26
32
28
20

32
30
28
38
16
18
14
36
34

GARDEN DEBRIS CONTAINER

BACKGROUND OF THE INVENTION

1. Field of the Invention

The present invention relates to refuse containers and more particularly pertains to a new garden debris container for easy collection of garden debris.

2. Description of the Prior Art

The use of refuse containers is known in the prior art. More specifically, refuse containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,600,113; 3,170,183: U.S. Pat. No. Des. 357,779; U.S. Pat. Nos. 3,875,981; 4,697,835; and U.S. Pat. No. 5,088,531.

While these devices fulfill their respective, particular objectives and requirements, the aforementioned patents do not disclose a new garden debris container. The inventive device includes a housing. The housing has a bottom wall. A peripheral wall is coupled to and extends away from the bottom wall. The peripheral wall has free edge. A flange is coupled to the free edge of the peripheral wall. The flange extends in a direction generally away from the bottom wall.

In these respects, the garden debris container according to the present invention substantially departs from the conventional concepts and designs of the prior art, and in so doing provides an apparatus primarily developed for the purpose of easy collection of garden debris.

SUMMARY OF THE INVENTION

In view of the foregoing disadvantages inherent in the known types of refuse containers now present in the prior art, the present invention provides a new garden debris container construction wherein the same can be utilized for easy collection of garden debris.

The general purpose of the present invention, which will be described subsequently in greater detail, is to provide a new garden debris container apparatus and method which has many of the advantages of the refuse containers mentioned heretofore and many novel features that result in a new garden debris container which is not anticipated, rendered obvious, suggested, or even implied by any of the prior art refuse containers, either alone or in any combination thereof.

To attain this, the present invention generally comprises a housing. The housing has a bottom wall. A peripheral wall is coupled to and extends away from the bottom wall. The peripheral wall has free edge. A flange is coupled to the free edge of the peripheral wall. The flange extends in a direction generally away from the bottom wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present Invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garden debris container apparatus and method which has many of the advantages of the refuse containers mentioned heretofore and many novel features that result in a new garden debris container which is not anticipated, rendered obvious, suggested, or even implied by any of the prior art refuse containers, either alone or in any combination thereof.

It is another object of the present invention to provide a new garden debris container which may be easily and efficiently manufactured and marketed.

It is a further object of the present invention to provide a new garden debris container which is of a durable and reliable construction.

An even further object of the present invention is to provide a new garden debris container which is susceptible of a low cost of manufacture with regard to both materials and labor, and which accordingly is then susceptible of low prices of sale to the consuming public, thereby making such garden debris container economically available to the buying public.

Still yet another object of the present invention is to provide a new garden debris container which provides in the apparatuses and methods of the prior art some of the advantages thereof, while simultaneously overcoming some of the disadvantages normally associated therewith.

Still another object of the present invention is to provide a new garden debris container for easy collection of garden debris.

Yet another object of the present invention is to provide a new garden debris container which includes a housing. The housing has a bottom wall. A peripheral wall is coupled to and extends away from the bottom wall. The peripheral wall has free edge. A flange is coupled to the free edge of the peripheral wall. The flange extends in a direction generally away from the bottom wall.

Still yet another object of the present invention is to provide a new garden debris container that has a flange thereon for placement upon the ground such that debris does not travel under the peripheral wall of the housing.

Even still another object of the present invention is to provide a new garden debris container that has a handle and wheels thereon for ease of moving the housing.

These together with other objects of the invention, along with the various features of novelty which characterize the invention, are pointed out with particularity in the claims annexed to and forming a part of this disclosure. For a better understanding of the invention its operating advantages and the specific objects attained by its uses reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
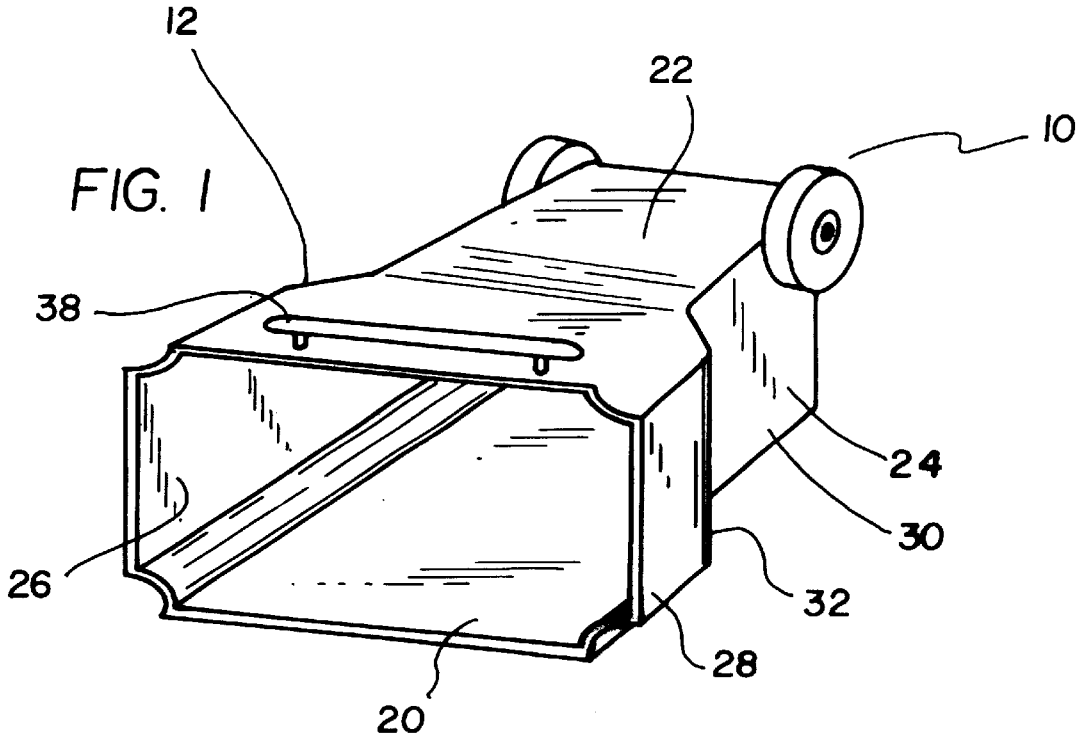
FIG. 1 is a schematic perspective view of a new garden debris container according to the present invention.
Figure 2:
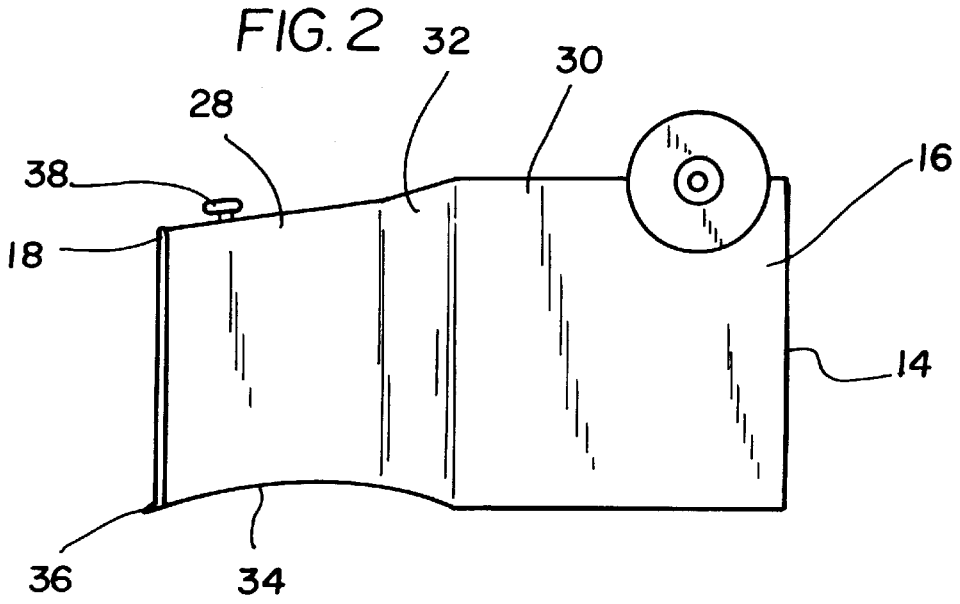
FIG. 2 is a schematic side view of the present invention.
Figure 3:
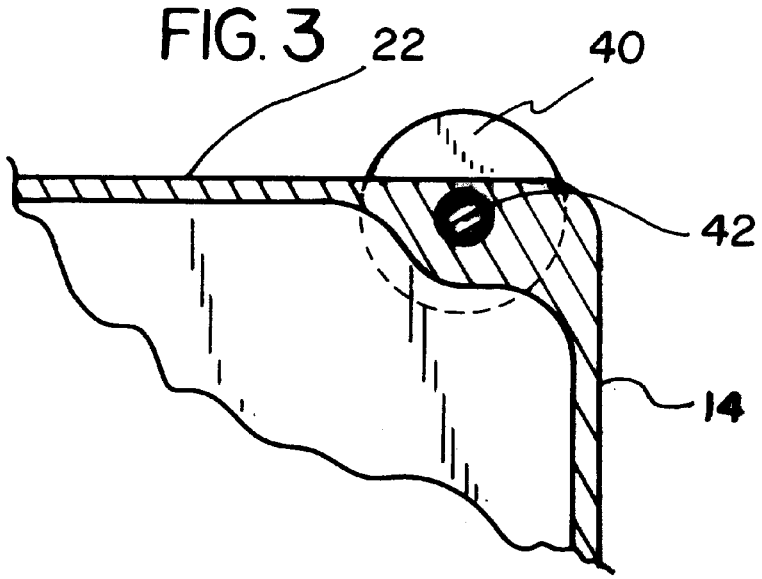
FIG. 3 is a schematic cross-sectional view of the axle of the wheels of the present invention.
Figure 4:
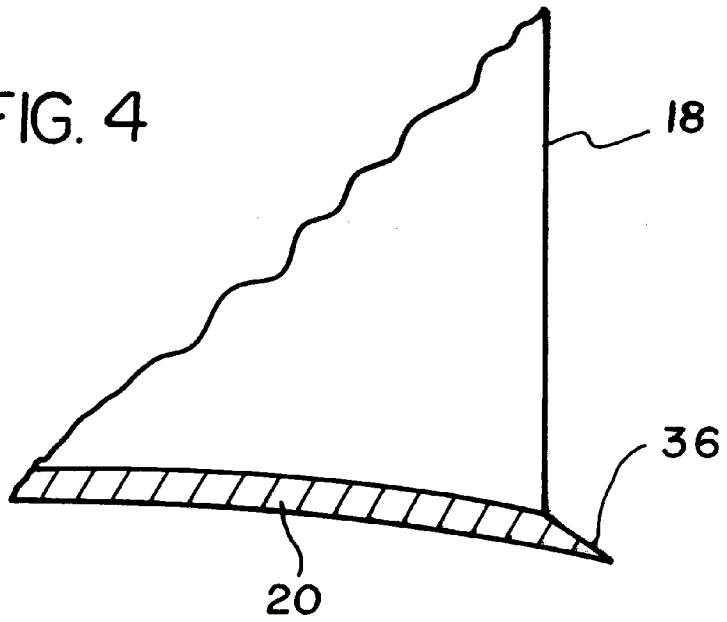
FIG. 4 is a schematic cross-sectional view of the front wall and flange of the present invention.

With reference now to the drawings, and in particular to FIGS. 1 through 4 thereof, a new garden debris container embodying the principles and concepts of the present invention and generally designated by the reference numeral 10 will be described.

As best illustrated in FIGS. 1 through 4. The garden debris container 10 generally comprises a housing 12. The housing 12 has a bottom wall 14. A peripheral wall 16 is coupled to and extends away from the bottom wall 14. The peripheral wall 16 has free edge 18. The peripheral wall 16 includes a front wall 20, a back wall 22, a first side wall 24 and a second side wall 26. The peripheral wall 16 has distal portion 28 and a proximal portion 30. The proximal portion 30 is generally abutted against the bottom wall 14. The distal portions 28 of the front 20 and back 22 walls have a width greater than a width of the proximal portions 30 of the front 20 and back 22 walls such that a shoulder 32 is formed between the distal 28 and proximal 30 portions of the first 24 and second 26 side walls. An exterior surface 34 of the distal portion 28 of the front wall 20 is concave. Preferably, each of the walls has a height between three and five feet, the distal portions 28 of the front 20 and back 22 walls have a width between two and three feet, and the distal portions 28 of the first 24 and second 26 walls have a width between eighteen and twenty-eight inches. Ideally, each of the walls has a height generally equal to four feet, the distal portions of the front and back walls have a width of thirty inches, and the distal portions of the first and second side walls have a width of twenty-two inches.

A flange 36 is coupled to the free edge 18 of the peripheral wall 16. The flange 36 extends generally away from the bottom wall 14. The flange 36 is generally positioned abutted to and along a length of the front wall 34.

A handle 38 is fixedly coupled to the back wall 22. The handle is preferably positioned generally adjacent to the free edge 18 of the peripheral wall 16.

A pair of wheels 40 is rotatably coupled to the housing. Each of the wheels 40 is rotatably coupled to one of the side walls 24, 26. Preferably, an axle 42 runs through the housing 12. The wheels 40 are coupled to opposite ends of the axle 42. Each of the wheels 40 is generally adjacent to the bottom wall 14 and the back wall 22.

In use, the housing 12 is tipped on its side such that the front wall 20 is positioned on the ground. The concave nature of the front wall 20 positions the flange 36 against the ground. The flange 36 and the concave nature of the front wall 20 allow the user to easily slide, rake or otherwise place debris or other items into the housing 12. When finished, the handle 38 is used to place the housing 12 in an upright position and the wheels 40 facilitate movement of the housing 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A lawn debris receptacle device, said device comprising:

a housing, said housing having a bottom wall, a peripheral wall being coupled to and extending away from said bottom wall, said peripheral wall having free edge; and a flange, said flange being coupled to said free edge of said peripheral wall, said flange extending generally in a direction away from said bottom wall; and wherein said peripheral wall of said housing comprises a front wall, a back wall, a first side wall and a second side wall, each of said walls having a distal portion and a proximal portion, an exterior surface of said distal portion of said front wall being concave, an exterior surface of said proximal portion of said front wall extending in a first plane for resting on a ground surface when said housing is in a tipped position;

wherein a portion of the free edge on said front wall of said peripheral wall lies in the first plane of said proximal portion of said front wall such that said free edge is positioned on the ground surface when the exterior surface of said proximal portion of said front wall lies on the ground surface.

2. A lawn debris receptacle device as in claim 1, wherein said proximal portion is generally abutted against said bottom wall, said distal portions of said front and back walls having a width greater than a width of said proximal portions of said front and back walls such that a shoulder is formed between said distal and proximal portions of said first and second side walls, an exterior surface of said distal portion of said front wall being concave and wherein said flange being positioned generally adjacent to said front wall.

3. A lawn debris receptacle device as in claim 1, further comprising:

a handle, said handle being fixedly coupled to said back wall, said handle being positioned generally adjacent to said free edge of said peripheral wall.

4. A lawn debris receptacle device as in claim 1, further comprising:

a pair of wheels, each of said wheels being rotatably coupled to one of said side walls, each of said wheels being generally adjacent to said bottom wall and said back wall.

5. A lawn debris receptacle device, said device comprising:

a housing, said housing having a bottom wall, a peripheral wall being coupled to and extending away from said bottom wall, said peripheral wall having free edge, said peripheral wall comprising a front wall, a back wall, a first side wall and a second side wall, said peripheral wall having distal portion and a proximal portion, wherein said proximal portion is generally abutted against said bottom wall, said distal portions of said front and back walls having a width greater than a width of said proximal portions of said front and back walls such that a shoulder is formed between said distal and proximal portions of said first and second side walls;

a flange, aid flange being coupled to said free edge of said peripheral walls said flange extending generally in a direction away from said bottom wall, said flange being generally positioned abutted to and along a length of said front wall;

an exterior surface of said distal portion of said front wall being concave, all exterior surface of said proximal portion of said front wall extending in a first plane for resting on a ground surface when said housing is in a tipped position;

wherein a portion of the free edge on said front wall of said peripheral wall lies in the first plane of said proximal portion of said front wall such that said free edge is positioned on the ground surface when the exterior surface of said proximal portion of said front wall lies on the ground surface;

a handle, said handle being fixedly coupled to said back wall, said handle being positioned generally adjacent to said free edge, and a pair of wheels, each of said wheels being rotatably coupled to one of said side walls, each of said wheels, being generally adjacent to said bottom wall and said back wall.

* * * * *